US006164726A

United States Patent [19]

Reeves et al.

[11] Patent Number: 6,164,726

[45] Date of Patent: Dec. 26, 2000

[54] FOLDING CHAIR

[76] Inventors: Christina M. Reeves; Christopher J. Reeves, both of 3203-10 Yonge Street, Toronto, Ontario, Canada, M5E 1R4

[21] Appl. No.: 09/064,621

[22] Filed: Apr. 23, 1998

[30] Foreign Application Priority Data

Apr. 22, 1998 [CA] Canada ..... 2235543

[51] Int. Cl.[7] ..... A47C 4/00; A47C 7/02

[52] U.S. Cl. ..... 297/452.63; 297/352; 297/380; 297/252; 297/382; 297/16.2; 297/17; 297/229; 297/218.1; 297/219.1

[58] Field of Search ..... 297/452.63, 16.2, 297/17, 218.1, 219.1, 225, 228, 229, 252, 352, 382, 380

[56] References Cited

U.S. PATENT DOCUMENTS

| | | | |
|---|---|---|---|
| 936,252 | 10/1909 | Wilckerling et al. | 297/352 |
| 1,161,420 | 11/1915 | Snelling | 297/252 |
| 1,422,319 | 7/1922 | Stoll | 297/16.2 X |
| 1,450,387 | 4/1923 | Reece | 297/382 |
| 1,450,703 | 4/1923 | Reece | 297/382 |
| 1,452,882 | 4/1923 | Loesch | 297/382 |
| 1,577,331 | 3/1926 | Lopez | 297/382 |
| 1,852,323 | 4/1932 | Long . | |
| 2,001,252 | 5/1935 | Johnson . | |
| 2,108,531 | 2/1938 | Flanders | 297/352 X |
| 2,306,673 | 12/1942 | Tucker | 297/252 |
| 2,457,978 | 1/1949 | Curran | 297/380 X |
| 2,518,971 | 8/1950 | Zillig | 297/352 X |
| 2,607,400 | 8/1952 | Witz | 297/380 |
| 2,702,076 | 2/1955 | Beardsley et al. | 297/252 |
| 2,797,743 | 7/1957 | Rodtz, Jr. | 297/229 |
| 3,139,307 | 6/1964 | Hawley et al. . | |
| 3,310,341 | 3/1967 | Connell | 297/252 |
| 3,515,430 | 6/1970 | Nelson | 297/218.1 |
| 4,605,261 | 8/1986 | Lee | 297/16.2 |
| 4,671,566 | 6/1987 | Knapp et al. | 297/16.2 |
| 4,836,601 | 6/1989 | Gene | 297/16.2 |
| 5,100,203 | 3/1992 | Novak | 297/382 |
| 5,150,945 | 9/1992 | Aupperlee et al. | 297/229 X |
| 5,385,390 | 1/1995 | Freeman et al. | 297/17 X |
| 5,433,502 | 7/1995 | Condorodis et al. | 297/17 |
| 5,499,857 | 3/1996 | Lynch, Jr. | 297/16.2 |
| 5,516,193 | 5/1996 | Simpson | 297/352 X |
| 5,709,431 | 1/1998 | Horn | 297/219.1 X |

FOREIGN PATENT DOCUMENTS

| | | | |
|---|---|---|---|
| 2001905 | 6/1997 | Greece . | |
| 483942 | 2/1970 | Switzerland | 297/218.1 |

*Primary Examiner*—Peter M. Cuomo
*Assistant Examiner*—Rodney B. White

[57] ABSTRACT

A folding chair is described of the type having a seat portion and a back portion joined by a fabric hinge. The seat and back portions have an array of stiffeners, the stiffeners each having one end mounted in the hinge and another end retained in an end retainer. The outermost slats are provided with a slot through which a pair of stays are wound to limit the opening of the back and seat portions relative to each other. The retainers and the hinge capture the ends of the slats in an interference fit. Some or all of the slats may be glued in place with a waterproof glue. A dual purpose cover is provided for enveloping the chair in a folded position for carrying and also for overlaying the chair when in a position for use.

19 Claims, 8 Drawing Sheets

FOLDING CHAIR

FIELD OF INVENTION

This invention relates generally to folding chairs of the type that can be rolled up and carried by the user to a suitable location. In particular it relates to the field of seating having longitudinal stiffeners and flexible coverings.

BACKGROUND ART

It has been known for many years to make a type of chair that has slats and a fabric hinge, such that the chair can be rolled up. Chairs of this type are shown, for example, in U.S. Pat. No. 2,001,252 issued to Johnson on May 14, 1935 and in U.S. Pat. No. 5,100,203 issued Mar. 31, 1992 to Novak.

In this kind of chair there are, typically, three pieces of webbing, generally made of canvas, with pouches, or pockets, sewn in them. One piece of webbing forms the hinge of the chair, and has pockets on both sides. A number of slats are provided, half of the slats being used for the seat of the chair, and half of the slats being used for the back. Each of the slats has one end that is secured in a pocket of the hinge piece of webbing. The other end of each slat is secured in a pocket of one of the other pieces of webbing. The top and bottom edges of the chair are formed by these other pieces of webbing, and the relationship of the sewn pockets is such as to maintain the relative, generally parallel positions of the adjacent slats of the back and seat portions of the chair. The opening of the chair is limited by a pair of straps, one each on either side of the chair, that extend from the outermost seat slat on each side to the outermost back slat on each side. These straps are connected, generally, to the respective slats at or near the end pieces of webbing.

When a person sits on the seat portion of the chair, the limit of opening of the back relative to the chair is determined by the length of the straps. The slats draw in around the body, and tend to provide stiffening to support the user's back. A slat chair of this type, of the proper size, is intended to hug the body quite comfortably. Chairs of this nature are generally light enough to be carried easily, whether to the beach, or to sit in bleachers, or to use as a camping or fishing chair.

These chairs have the advantage of being foldable, and, when folded, have the ability to be rolled up into a relatively small package. Portable folding chairs are known that employ nylon covered padding for the seat and back portions of a folding chair, with battens placed along opposite sides of the back portion, inside the nylon covering. These chairs are not entirely satisfactory. First, when used at the beach, for example, the nylon does not permit as much air movement around the body as an array of slats with spaces between them, and, depending on the user's taste, may not be found adequately comfortable against the skin or a bathing suit. Second, in two types of chair, the foam padding used in the back and seat is not as stiff as an array of slats, and consequently does not provide the same vertical back support. In one of those two types, while the back is not as stiff as an array of slats, it is too stiff to facilitate easy rolling up of the chair in the rolling direction, that is, the direction generally perpendicular to the slats.

The present inventors have also noted a number of disadvantages with other existing examples of the slat type of chairs. First, according to the commentary in U.S. Pat. No. 5,100,203 the chair disclosed in U.S. Pat. No. 2,001,252 either allowed the slats to float free in the pockets, or employed rivets to fasten the slats to the pockets. The use of rivets was thought to weaken the slats. In U.S. Pat. No. 5,100,203 Novak used divergent closure staple means which penetrated inwardly from the outside of the web pieces, but did not pierce the inside wall of the web piece.

The present inventors have found that metal fasteners tend to work in the web, or fabric, and may rip out. Alternatively, when staples are used, they may catch on the ends of the fingers, or on finger nails, pierce the skin, or catch on clothing, which is not always an enjoyable experience for the user. Further, depending upon the type of staple or rivet used, the staple may tend to oxidize. In the worst case, with mild steel staples in a sea salt atmosphere, rust forms on the staples, and unsightly rust streaks appear on the webbing. Rust may tend to rot the material, and the material may tend to tear away from the rusted staple.

A third problem is that even when rivets or staples are used, the slats tend to work in the pockets, which may result in unnecessary wear to the chair, and may also result in the slats not maintaining the desired relationship one to another, with the chair becoming more shifty than may be desired.

A fourth problem is caused by a combination of factors. First, canvas material is available in standard widths. A chair of this nature is generally such that a manufacturer might tend to think first of trimming manufacturing costs to the maximum extent possible. In one type of chair presently sold, it appears that the webbing pieces have been cut to maximise the number of pieces that can be obtained from a standard width. This chair has several ⅝" slats, with roughly ½" clearance between adjacent slats. The overall unstretched developed width of the slat array is roughly 14¾". When used by an average sized, or larger, North American adult, the ends of the outer-most slats may tend to dig into the user's sides. This may cause discomfort, first from lateral pinching of the body generally, and second from the quite uncomfortable experience of the ends of the outer back slats digging into the ribs.

The present inventors have noted that this discomfort can be reduced or eliminated by one or more measures. First, a greater use of material allows the slats to be more widely separated. This results in a relatively minor increase in the amount of material used, and in the weight of the chair, yet permits average, or larger, persons to sit more comfortably. It is also a more efficient structure, since the weight that can be contained within the chair increases without a need to increase the size, number, or weight of the slats. That is, the ratio of the load per unit weight of the chair improves.

This can be further enhanced by using a heavy or very heavy grade of canvas, and folding it to double the thickness, or by lining the pockets with cushioning material, or both.

Further still, by using a heavy grade of material, by folding it to double its thickness, and by sewing the pockets slightly undersized, the slats can be located more snugly in the pockets formed in the end pieces and in the hinge. Conceptually this is akin to an interference fit. A tight fit discourages the slats from working within the material as easily. This tends to maintain the slats in their desired orientation relative to each other.

The use of a water proof glue has the advantage of not relying upon a metal fastener that can oxidise and cause streaking. Further, unlike rivets or staples, which tend to approximate a point contact, glue can be applied along a line of contact, or over a wider area generally, such that the web stresses that are transferred to and from the slats tend not to be as highly concentrated at a single point or points.

Continuing with their efforts to reduce the tendency of the outer corners of the outermost slats to dig into the ribs, the inventors have eased the corners of the slats. That is, they have mitred the outer corners, and then made a smoothly radiused tip. Further, the inventors have introduced a smoothly radiused, obliquely angled, oblong slot into the outermost slats. The stay strap extends, in use, to wrap around the outer most slats at an angle. As the material is wrapped around the back of the slat it continues on the angle. In previous chairs a staple or rivet was driven through the strap on the to hold it in place. But, the inventors continue to wrap the strap through the slot, and then up the front side of the slat at an angle more or less perpendicular to the chamfer. The strap is carried over the chamfer and back down the rear side of the slat, where it can be secured to the slat and to itself with glue. The folded over end of the strap can be tucked under itself. Without the slot the strap would have to meet the slat at a point closer to the hinge.

In some conditions, such as ice fishing, or watching sporting events in the fall, it may be desirable to be able to insert an additional cushion, or a heating pad, in either the seat or the back of such a chair.

Finally, in some instances may be desirable to taper the back rest, according to a user's body shape. Differing the amount of webbing between adjacent slats does not generally alter the tendency of the slats to roll up in a generally cylindrical manner when not in use.

SUMMARY OF THE INVENTION

In an aspect of the invention there is a foldable chair comprising a seat joined to a backrest at a hinge and a pair of outboard stays operable to limit opening of the backrest relative to the seat. The backrest has an array of stiffeners extending away from the hinge in a first direction, and a spacing governor mounted to the array of stiffeners to maintain the stiffeners in position relative to each other. The backrest is moveable to a closed position relative to the seat, and, in said closed position said chair being rollable in a second direction transverse to said first direction. The array of stiffeners of the backrest includes a pair of outboard stiffeners. Each of the outboard stiffeners has a first region thereof located distant from the hinge, the first region having a stay aperture defined therein. The aperture is of a size to permit an end of the stay to be introduced therethrough.

In an additional feature of that aspect of the invention the aperture is a slot with smoothly radiused ends. In another additional feature of that aspect of the invention, the stiffener is a slat and the aperture is a slot having a slot length oriented such that, when the chair is in an open position with a portion of the stay extending away from the slot, a projection of said length parallel to the portion of the stay extending away from said slot is less than 1.5 times the width of the stay. In still another additional feature of that aspect, each of the outboard stiffeners is a slat, and each of the slots is a slot having a slot length oriented such that in an open position of the chair, a projection of the length parallel to the portion of the stay extending away from said slot toward the seat is substantially equal to the width of the stay. In a still further alternative feature of that aspect of the invention the aperture has a width less than thrice the thickness of the stay. In a yet further alternative feature of that aspect of the invention the aperture has a width substantially equal to the dry, unstressed thickness of the stay.

In a yet further alternative or additional feature of the invention, the outboard stiffener is a slat and has a chamfered end located distant from the hinge, and said aperture is oriented to permit a stay end introduced therethrough to be wound about the chamfered end. In an additional feature of that additional feature, the aperture is oriented to permit a stay end introduced therethrough to be wound substantially perpendicularly about the chamfer.

In a still further additional or alternative feature of that aspect of the invention, the stiffener is a slat having a smoothly radiused end locatable distant from the hinge. In an additional feature of that additional feature, the slat has an inside edge and a smoothly radiused corner between said chamfered end and the inside edge.

In another aspect of the invention, there is a portable chair which includes the stiffener of the above aspect of the invention, a backrest and a seat joined by a hinge and a pair of stays. The stiffener is part of the backrest and is located to extend away from the hinge with the aperture located distant from the hinge.

In an additional feature of this second aspect of the invention, the backrest includes a pair of the stiffeners located in opposed outboard regions thereof. In a yet further feature of that additional feature of the invention, the stiffeners located in opposed outboard regions of the backrest terminate at distal ends and the distal ends are smoothly radiused and padded.

In another aspect of the invention, there is a foldable chair comprising a seat joined to a backrest at a hinge and a pair of outboard stays extending between the backrest and the seat, the stays being operable to limit opening of the backrest relative to the seat. The backrest has at least a pair of backrest stiffeners extending in a first direction away from the hinge. The stiffeners have distal portions located distant from said hinge, and, when said backrest is folded to a closed position against said seat, said chair being rollable in a second direction transverse to said first direction. There is a spacing governor having spaced apart retainers. The distal portions of the stiffeners are engaged in the retainers in spaced relationship from each other while in use, and at least two of the retainers are undersized relative to the respective stiffeners engaged therein, whereby the undersized retainers engage the distal portions of the respective stiffeners in a forced interference fit.

In an additional feature of this aspect of the invention, the governor has an array of retainers for receiving an array of stiffeners therein and the governor is fabricated from flexible webbing. In a further additional feature of that additional feature, the governor has a pair of webbing plies sewn together and said retainers are slots sewn in said webbing. In another additional feature of this aspect of the invention, the retainers are closed-ended pockets for receiving ends of the stiffeners therein. In an additional feature of that additional feature, the pockets are of a shape for receiving stiffeners in the form of slats having a width greater than their thickness and a depth that is at least as great as the width of the slats. In an alternative additional feature, the pockets have a depth at least twice as great as the width of said slats.

In another additional or alternative feature of that aspect of the invention the attachment is a harness for engaging at least a portion of the backrest. In a further alternative feature of that aspect of the invention the attachment includes a pocket for slipping over at least a portion of the backrest.

In another aspect of the invention, there is a kit comprising the cover of the previous aspect of the invention, and a foldable chair. The foldable chair has a seat joined to a backrest by a hinge and a pair of stays. The seat and the backrest are stiffened in a direction extending away from the hinge and are rollable in a transverse direction.

In a still further aspect of the invention there is a foldable chair having a seat joined to a backrest at a hinge. The seat has a pair of outboard stays extending between the backrest and the seat, the stays being operable to limit opening of the backrest relative to the seat. The backrest has at least a pair of backrest stiffeners, those stiffeners extending in a first direction away from the hinge. The stiffeners have distal portions located distant from the hinge. The seat and the backrest are stiffened in the first direction and, when the backrest is folded to a closed position against the seat, the chair is rollable in a second direction transverse to the first direction. There is a spacing governor having spaced apart retainers. The distal portions of the stiffeners are engaged in the retainers in spaced relationship from each other while in use, and at least two of the retainers are undersized relative to the stiffeners such that the undersized retainers engage the distal portions of said stiffeners in a forced interference fit. The stiffeners of the backrest include a pair of opposed are outboard stiffeners. Each of the outboard stiffeners has an aperture defined in the distal region thereof, and each of the stays has one end fed through one of apertures, that end being wound about its respective outboard stiffener and glued thereto.

DETAILED DESCRIPTION OF THE INVENTION

Figure 1A:
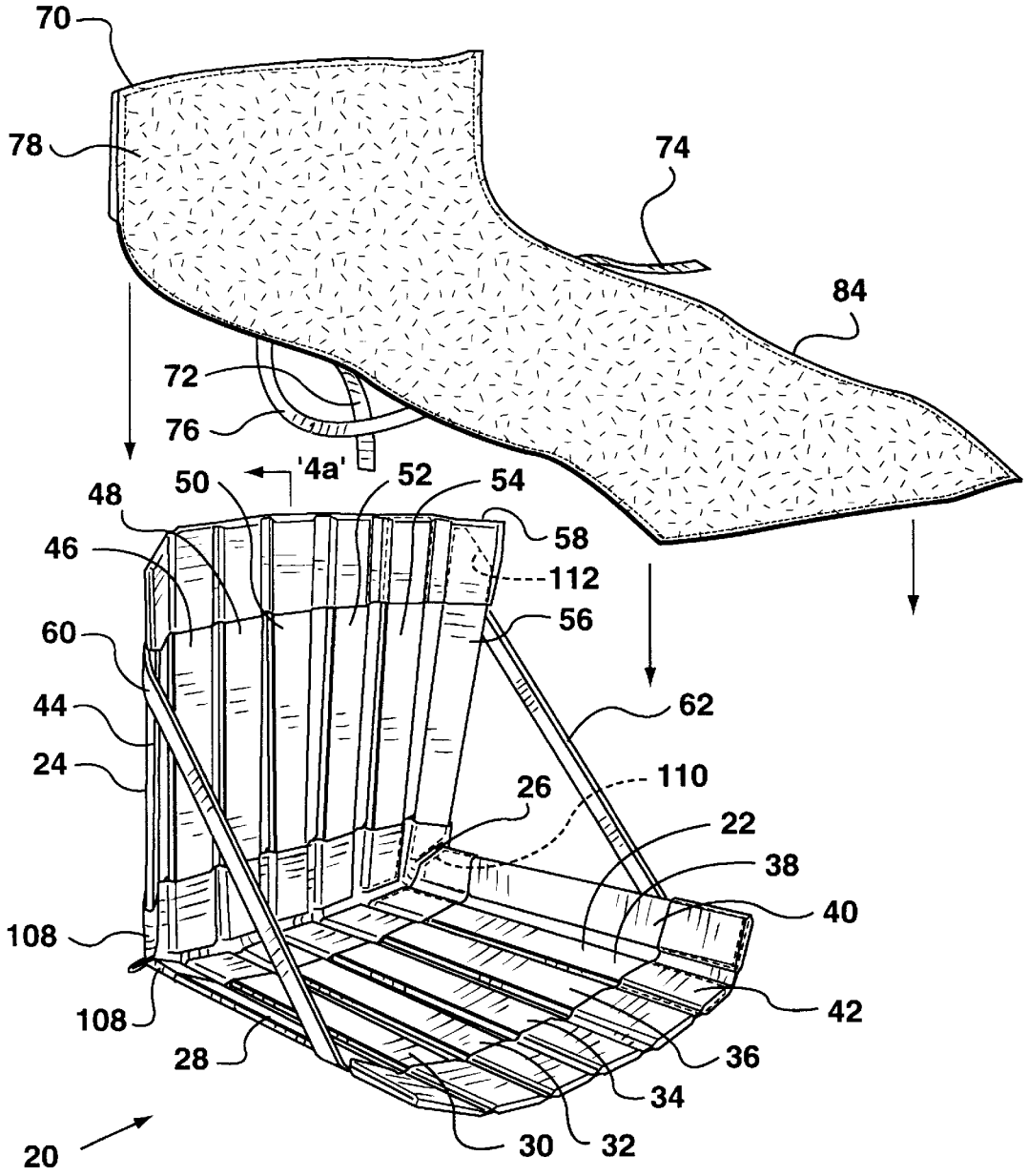
FIG. 1*a* is a general arrangement of a folding portable chair according to the present invention as deployed for use.

In the description which follows, like parts are marked throughout the specification and the drawings with the same respective reference numerals. The drawings are not necessarily to scale and in some instances proportions may have been exaggerated in order more clearly to depict certain features of the invention.

Figure 1B:
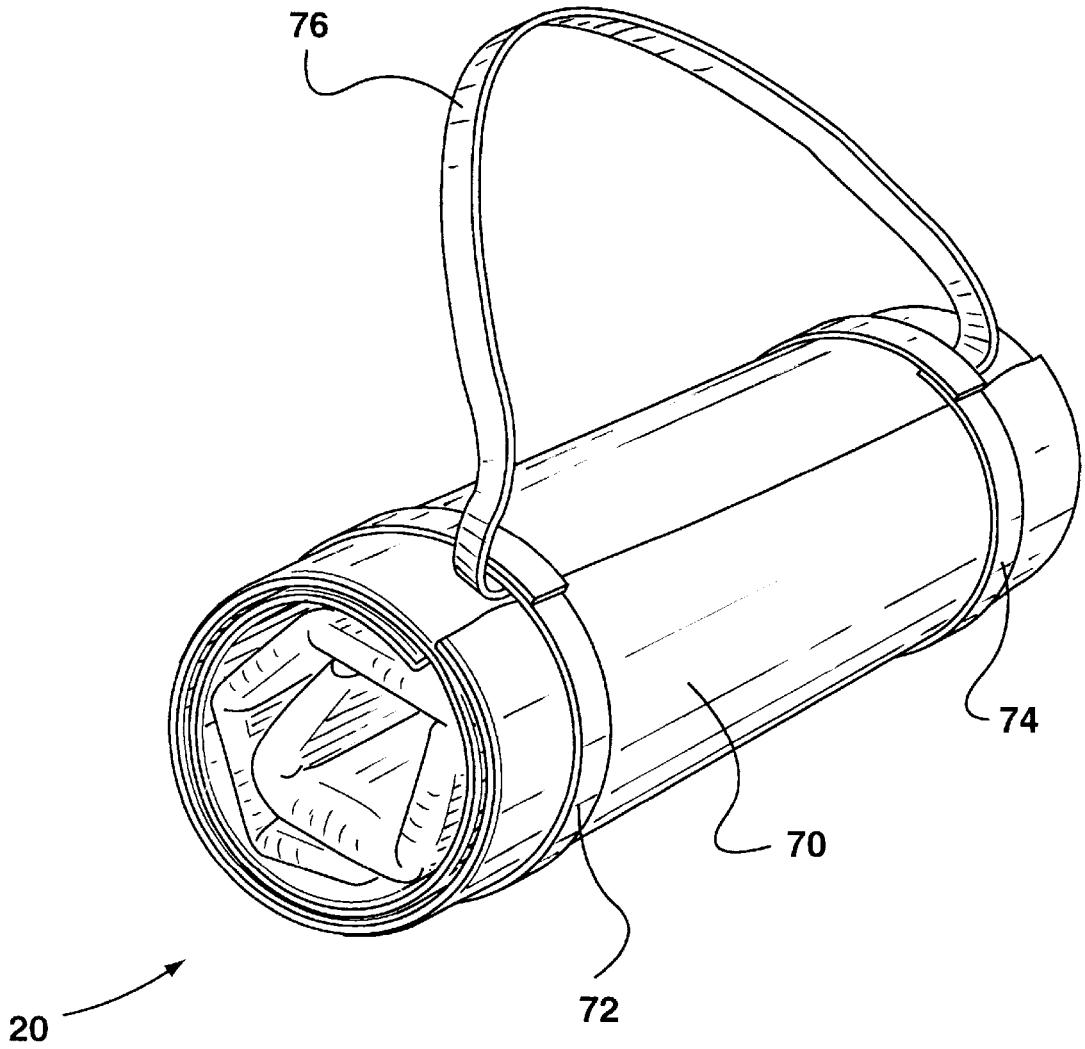
FIG. 1*b* shows the chair of FIG. 1*a* in a rolled up condition.

Referring to FIGS. 1*a* and 1*b*, an example of a collapsible portable folding chair of the present invention is indicated generally as 20. It has a seat portion 22 and a back portion 24 joined by a hinge 26 made of webbing. Seat portion 22 is made up of an array of stiffeners in the nature of seat slats 28, 30, 32, 34, 36, 38 and 40. Each of these slats has a proximal end mounted in hinge 26 and a distal end mounted in a seat distal end retainer 42. Similarly, the back portion is made up of an array of back rest stiffeners in the nature of back slats 44, 46, 48, 50, 52, 54 and 56, each having a proximal end mounted in hinge 26, and a distal end mounted in a back distal end retainer, 58. Chairs of this type are stiff in the longitudinal direction of the slats, in a manner that provides support for a person's spine, but are not stiff in the lateral direction which permits the slats to hug the body, and also permits the chair to be rolled up when not in use.

In the open, deployed position, shown in FIG. 1*a*, a pair of left and right hand stays 60 and 62, respectively, extend between fastening locations at or near the respective end retainers 42 and 58. These limit chair 20 from opening past a certain distance. They also carry a tensile stress into the slat arrays, and, effectively into the retainers 40 and 56, much as hasps carry the tensile hoop stress in a barrel.

Chair 20 can be folded into a closed position and rolled into a carrying position as shown in FIG. 1*b*. A dual purpose cover is shown generally as 70. When chair 20 is rolled up, cover 70 is wrapped around the outside. Cover 70 has closure straps 72 and 74 with mating hook and eye fabric fastenings. A carrying handle 76 is provided by which a beach goer, or other user, may comfortable carry chair 20. When the user arrives at the beach, or bleachers, for example, closure straps 72 and 74 are undone, cover 70 is removed, and can be used as described below.

Figure 2A:
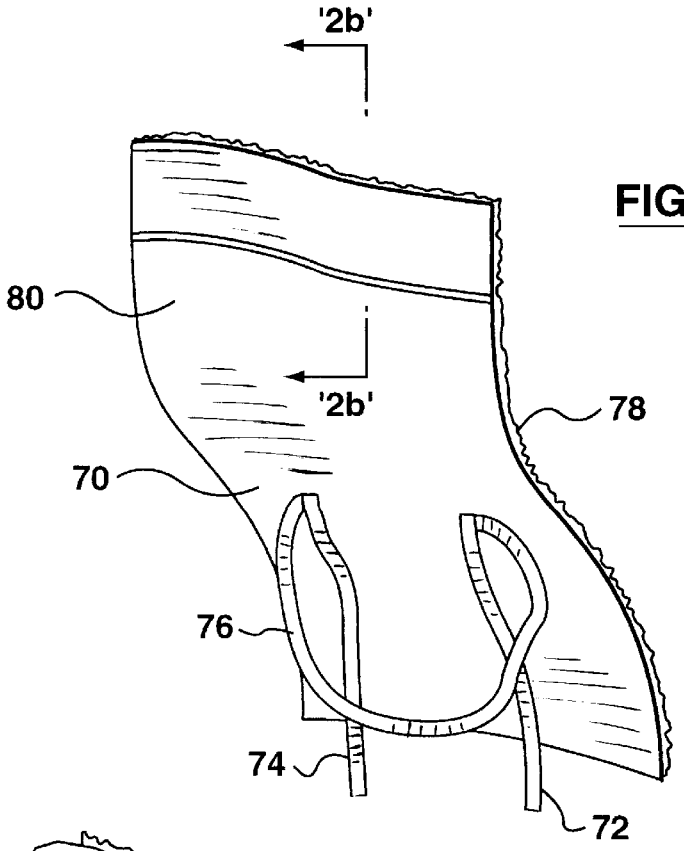
FIG. 2*a* is a view from behind of a cover of the chair of FIG. 1*a*.
Figure 2B:
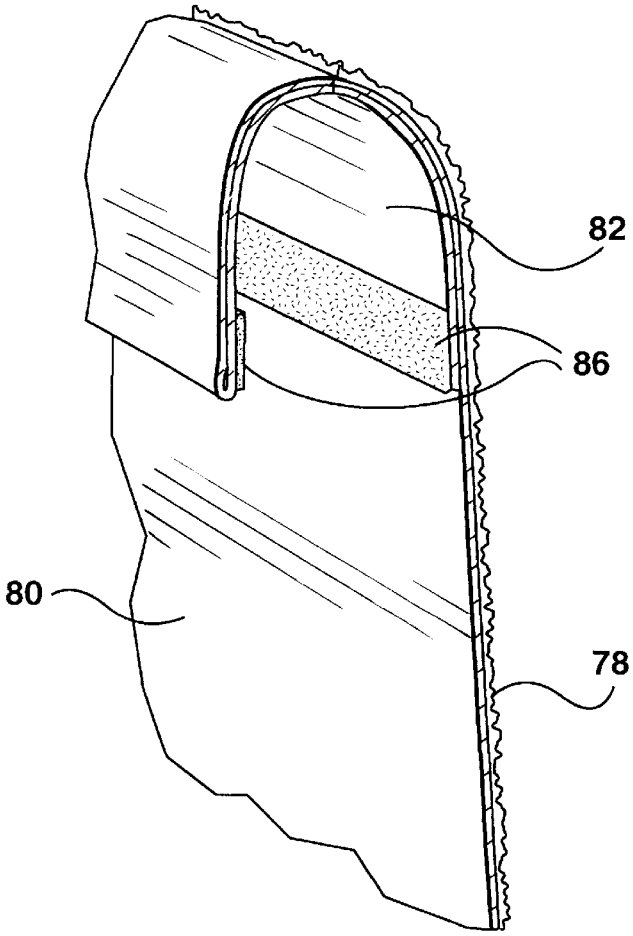
FIG. 2*b* is a section of the cover of FIG. 2*a* taken on section '2*b*—2*b*' of FIG. 2*a*.

As shown in more detail in FIGS. 2*a* and 2*b* cover 70 has an inner facing 78 that may be made, for example, from wool, imitation wool or another reasonably durable fabric material of comfortable texture suitable for serving the purpose of towelling, cushioning or insulation. It also has an outer fabric 80 of a suitable material, such as the canvas material used in the preferred embodiment. At one end of cover 70 there is a flap, or pocket 82, of a width for sliding over, and capturing, the distal ends of the slats of back portion 24 and back distal end retainer 58. The remainder of cover 70 forms a skirt 84 that hangs from pocket 82 down the front face of back portion 24 and can be draped over seat portion 22. When a user sits in chair 20 skirt 84 is intended to be of a suitable length to cover both back and seat portions 24 and 22.

One may choose not to sit, or repose, upon cover 70, but it may provide additional comfort when the user returns from bathing in the sea, for example, and wishes to sit on something that will tend to draw moisture away from the body. Alternatively, cover 70 provides a measure of insulation when sitting in a cool arena watching hockey, or while watching baseball or softball in the evening in Spring or Autumn. Conveniently, if one spills beverages or other sticky materials on cover 70, it can be removed and relatively easily washed without having to put the slat arrays through a washing machine or dry cleaning process. Among the fabrics which can be used for inner face 78 are wool, imitation wool, natural hair such as furs or sheepskin, synthetic wicking materials, corduroy, towelling, felt, plush, velvet, leather, suede, and canvas. In the preferred embodiment an imitation wool is used. Other means may be used to attach cover 70 to chair 20, such as a zipper around a portion of the periphery of the upper region of back portion 24, or a harness or elastic straps that can be stretched over the top corners of chair 20 or located about back portion 24. When chair 20 is rolled up within cover 70, the lip of pocket 82 is closed by use of hook and eye fabric fastening 86.

Figure 4A:
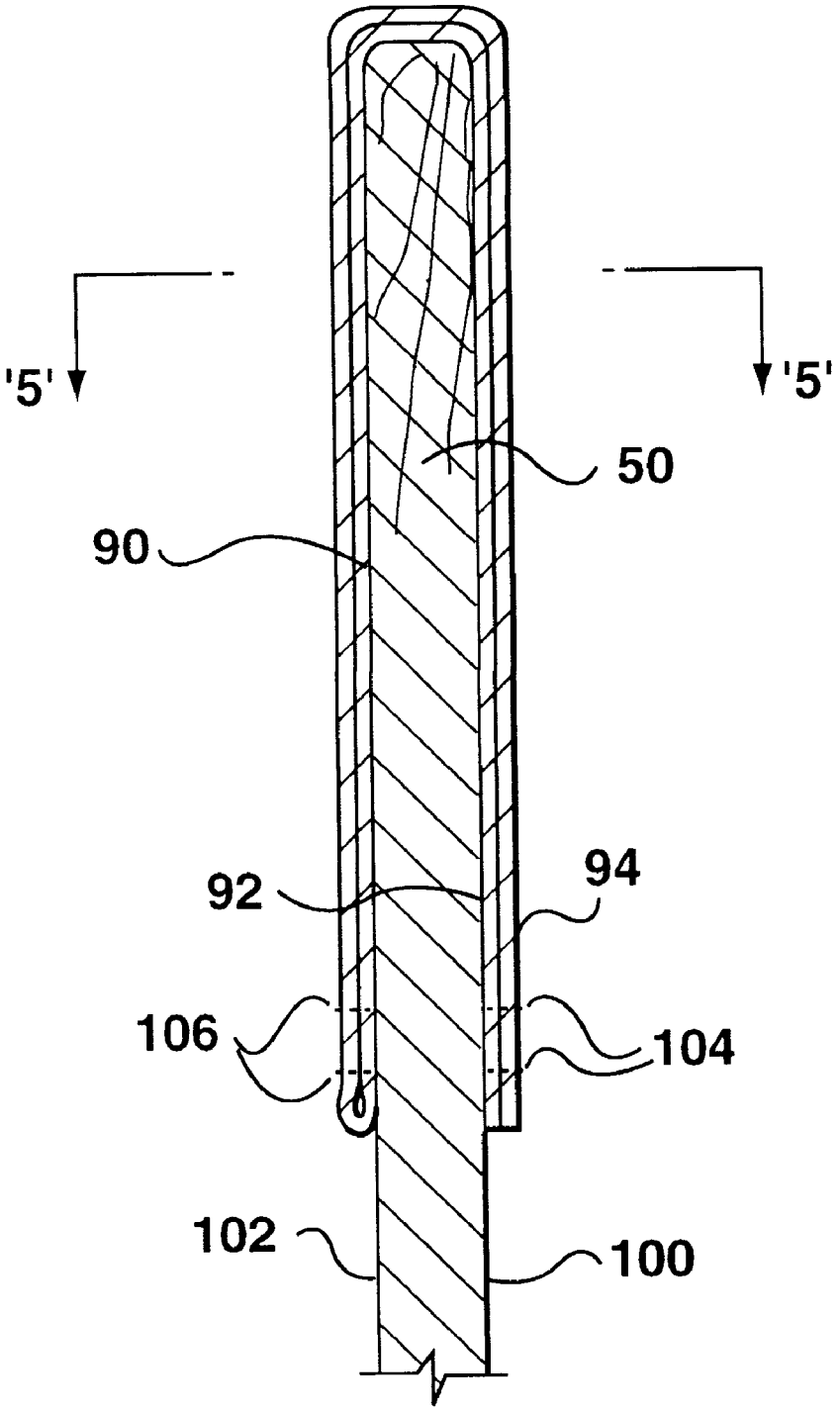
FIG. 4*a* shows a cross section of the chair of FIG. 1 taken on section '4*a*—4*a*'.

In the preferred embodiment seat and back portions 22 and 24 are interchangeable, although this need not be the case. In the general case of the intermediate slats, that is, any slats other than outside slats 28, 40, 44, and 56, all the slats are the same, and have smoothly rounded side edge corners 88, for the comfort of users and the discouragement of splinters. As shown in the representative cross section of FIG. 4*a*, back portion distal end retainer 58 has pockets 90 for receiving the distal ends of slats 44, 46, 48, 50, 52, 54, and 56. Hinge 26 has similar pockets for receiving the proximal ends of slats 28, 30, 32, 34, 36, 38, and 40, and slats 44, 46, 48, 50, 52, 54, and 56. Retainer 42 has corresponding pockets as well. Each pocket 90 is formed of doubly folded canvas, the inner folded layer indicated as 92, and an outer folded layer indicated as 94, sewn together. Double sewn longitudinal seams 96 and 98 define the lateral sides of each pocket 90. It is preferable that seams 96 and 98 be roughly parallel and be spaced apart a distance that yields an unstretched pocket size a bit smaller than the girth of the slat. In this way the slats are forced into place, stretching pocket 90, and yielding an interference fit. This discourages the slats from working in their respective pockets. Strong synthetic thread is preferred for use in the seams.

Figure 5:
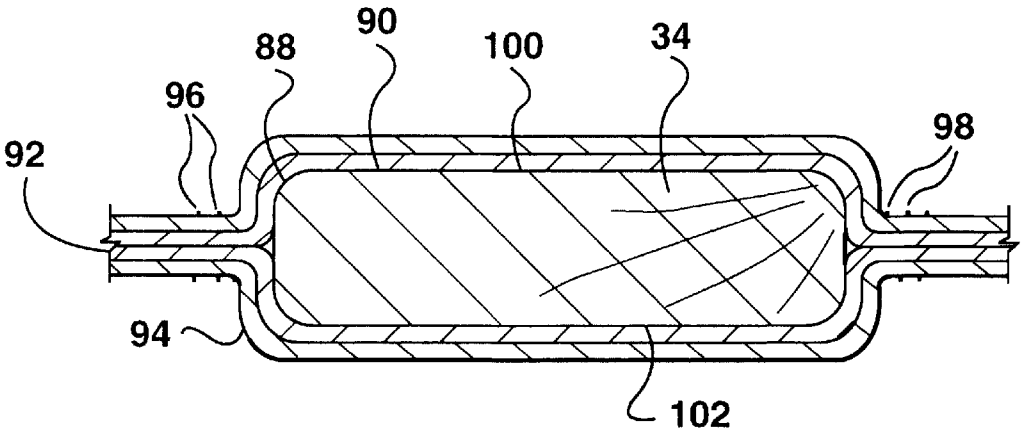
FIG. 5 shows a cross-section of the chair of FIG. 1*a* taken on section '5—5'.

The tendency to work in pocket 90 can be reduced by using a waterproof glue, or other suitable adhesive to bond layer 92 to, for example, slat 34. In the embodiment illustrated in FIG. 5, a slat outer face is designated as 100 and an inner face as 102. Inner folded layer 92 and outer folded layer 94 are sewn together laterally inside and out with a double pair of seams 104 and 106, respectively, near the mouth of pocket 90, and a waterproof glue is applied at roughly the same location, across the width of the slat. One can apply glue on every slat, both inside and out. Alternatively, glue can be applied only between outer face 100 and seams 106. In the preferred embodiment, the first, third, fifth, and seventh slats (such as 44, 48, 52, and 56) are glued in place, inside and out, at hinge 26 and end retainers 42 and 58, as the case may be. That is, the second, fourth, and sixth slats (such as slats 46, 50, and 52) are not glued in their respective pockets 90.

Another measure for discouraging the slats from working in pockets 90 is to choose a pocket depth that is at least as great as the slat width. A pocket depth that is at least 1.5 times the width of the slats is better, and the preferred pocket depth of the embodiment illustrated in FIGS. 1*a* and 1*b* is greater than 3", being more than 1.9 times the slat width.

Figure 3B:
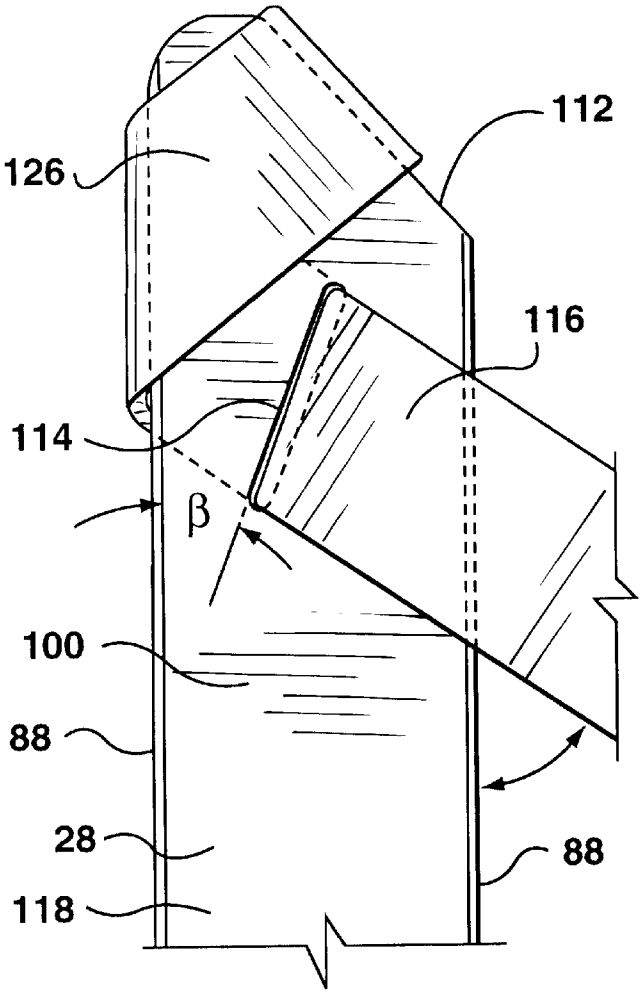
FIG. 3*b* is similar to FIG. 3*a*, showing the slat when viewed from the inside.
Figure 3A:
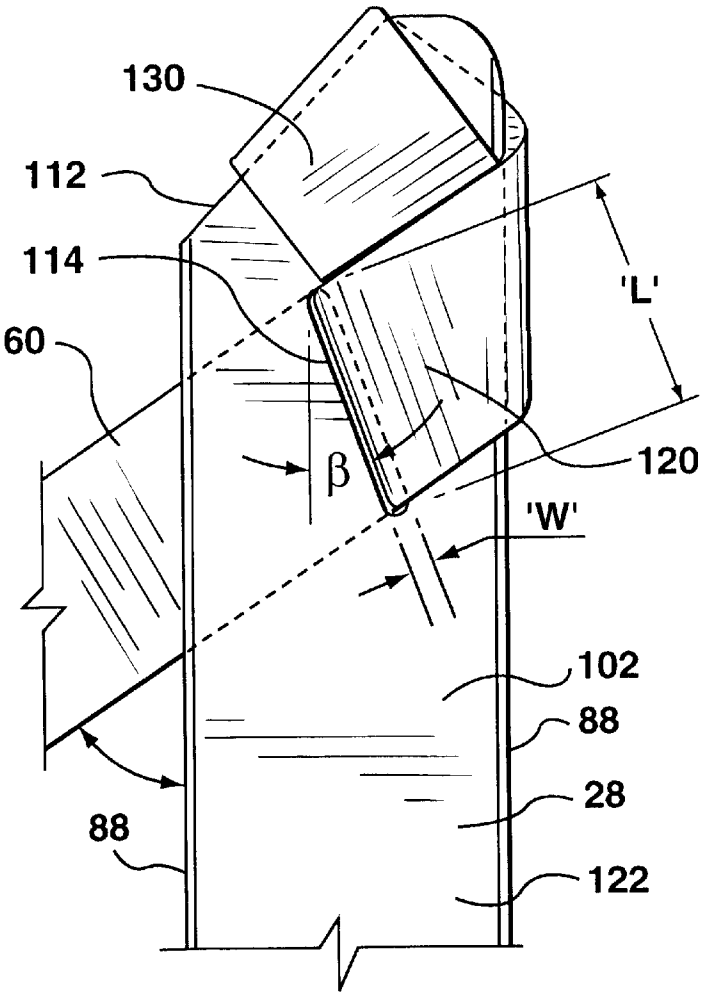
FIG. 3*a* is a view of a partially assembled edge slat of the invention of FIG. 1 viewed from the outside.

The outermost slats, 28, 40, 44 and 56 each have a chamfered proximal outer corner 110 at hinge 26, and a chamfered distal outer corner 112 at retainer 42 or 58 , as the case may be. Each has a slot 114 through which an end of one of stays 60 or 62 can be threaded in the manner shown in FIGS. 3*a* and 3*b*. As noted each stay has a first portion 116, lying along outer face 118 of slat 28, for example, and extending away from slot 114 at an angle a. A second portion 120 of stay 60 or 62, exits on angle a from slot 114 lies along inner face 122, and extends toward inner rounded edge 124 of slat 28, for example. Stay 60, or 62, is wrapped around edge 124 and has a third portion 126 lying along outer face 118, at the mirror angle of angle a. Stay 60 or 62 is further wrapped over chamfered outer corner 112 edge 128, and has a fourth portion 130 lying along inner face 122. In the embodiment illustrated third and fourth portions 126 and 130 extend more or less perpendicular to edge 128, and fourth portion 130 terminates in a manner more or less abutting the side of second portion 120.

Slot 114 is cut in slat 28, for example, at an angle β, as measured relative to the longitudinal direction of the slat, and has a length indicated as L and a width indicated as W. in the preferred embodiment width W approximates the thickness of the webbing material from which stay 60, or 62, is made. Although it is generally preferable for slot 114 to be tight, if the dimension is too tight, it is difficult to feed the webbing through the slot 114. Provided that the web can be compressed, it is possible for dimension W to be chosen for an interference fit. In the embodiment illustrated W is about 0.90 inches, slightly large than the web thickness, but smaller then the slat thickness, 0.25 inches. The slot length, L, is chosen such that a projection of L in the direction in which the first and second portions 116 and 120 extend is approximately equal to the width of the web material. That is, slot 114 does not necessarily lie perpendicularly to stays 60 or 62 as the case may be, at the intended design length of stays 60 and 62. In the preferred embodiment angle α is roughly 45 degrees, angle β is about 38 degrees, and slot 114 is not perpendicular to the web material. As shown, slot 114 is smoothly cut and has rounded ends.

In some instances the tightness of the fit between the webbing material and slot 114, and the wrapping around slat 28, for example, forms a friction fit akin to a knot, thereby encouraging stay 60 or 62 to remain in place without glue. In an alternative embodiment stay 60 or 62 could be tied to slat 28, 40, 44, or 56, as the case may be, and fourth portion 130 can be extended to permit it and top first portion 116 to overlap one another, and to be sewn or bonded together. Also, in the preferred embodiment slot 114 is normally hidden within either retainer 42 or retainer 58, although this need not necessarily be the case. In the preferred embodiment the first, second, third, and fourth portions 116, 120, 126, and 130 are glued in place with waterproof glue.

While seven slats are shown for each of the seat and back portions of chair 20, a greater or lesser number could be used. In one embodiment the clearance spacing between adjacent slats in an unstressed chair is greater than ⅝ inches, when using 1⅝ inch wide slats. In the most preferred embodiment the clearance between 1⅝" slats is about ¾ inches, (+/−1/16"), yielding a chair of suitable overall girth for a large proportion of North American adults. Larger spacings, or smaller spacings with a larger number of slats can also be chosen. The present inventors have developed an eight slat "large" embodiment, and a nine slat "extra large" embodiment. The unstretched developed width of the seven slat array illustrated is roughly 15⅞".

Figure 4B:
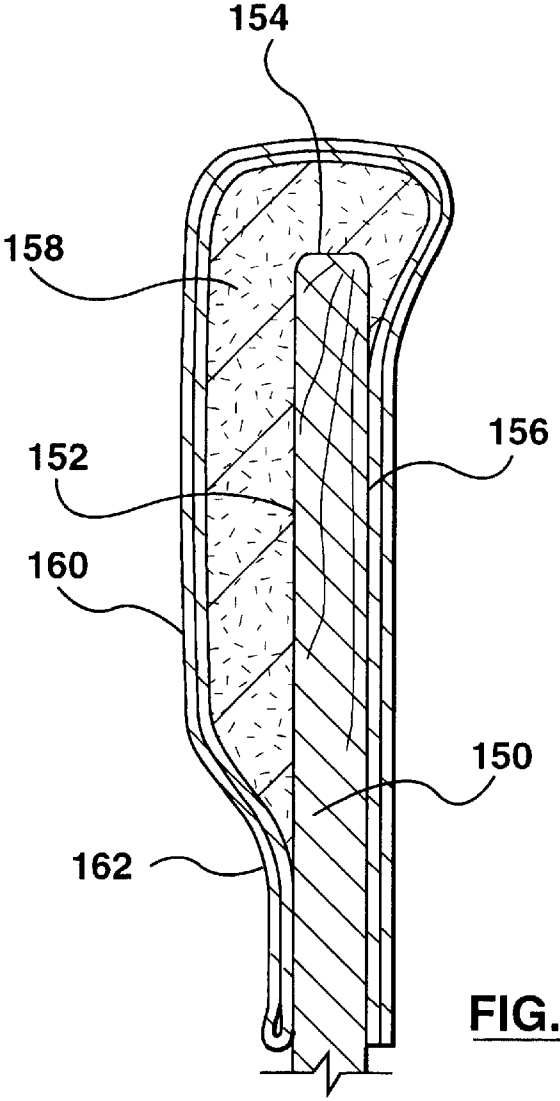
FIG. 4*b* shows an alternate cross-section to the cross-section of FIG. 4*a*.

In the alternative embodiment of FIG. 4*b*, a slat 150 is shown having an inner face 152, a distal end 154 and an outer face 156. Cushioning, or padding 158 has been wrapped about distal end 154 and extends some distance down inner face 152 within the envelope of a double folded wall 160 of a pocket 162. The proportions of the thickness of padding 158 to the thickness of slat 150 may vary from that shown. In an alternative embodiment, padding 158 can be used only to pad the ends of outmost slats such as slats 44 and 56.

Figure 6:
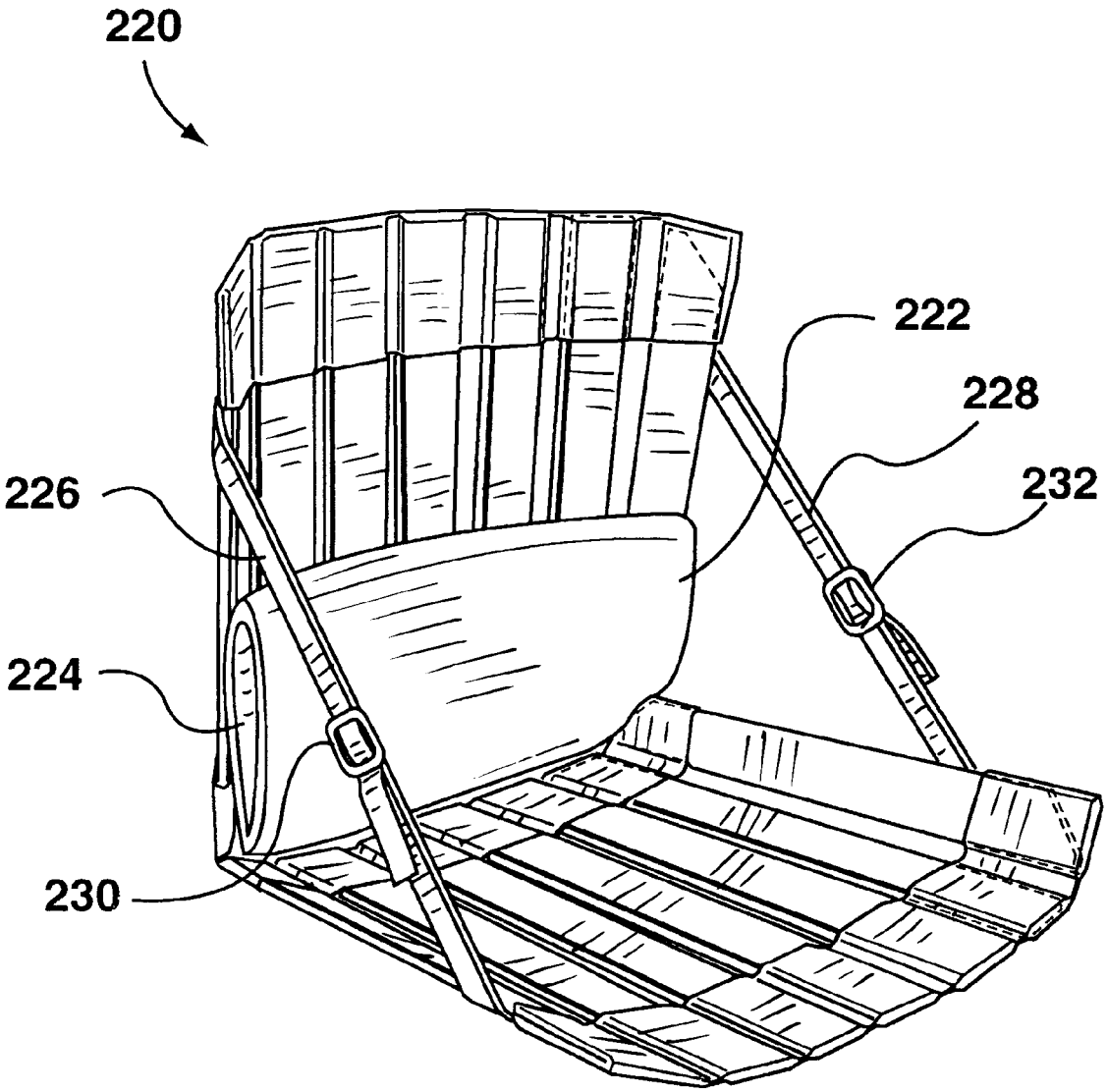
FIG. 6 shows an alternative embodiment to the chair of FIG. 1 in which a pouch is supported for a lumbar heating pad.

Another alternative embodiment of the invention is shown in FIG. 6, in which a chair 220 of similar nature to chair 20 has a pouch 222 for containing a lumbar or heating pad 224. A further feature illustrated in FIG. 6 concerns opposed stays 226 and 228. Although stays 60 and 62 are shown in FIGS. 1*a* and 1*b* as fixed length straps made of webbing, in the alternative embodiment of FIG. 6 stays 226 and 228 are provided with squeezable quick-release fittings 230 and 232 having a length adjustment. Thus a user may set the length for the most comfortable position. It is not necessary that pouch 222 be located on backrest portion 234 of chair 220. Rather it can be located in an appropriate position on cover 70, whether behind skirt 84, or between textured inner facing 78 and outer fabric 80.

While the preferred embodiment of the invention illustrated in FIGS. 1*a* and 1*b* employs seat and back slats of equal length (such that the seat and back are interchangeable, and a user can sit in the chair either way), they need not be of equal length, and one could use slats of unequal widths, possibly with the outer slats being slimmer than the inner slats. Further, it is not essential that the slats of the seat, or the slats of the back all be the same length. A chair back, or seat, or pleasing profile other than square is possible.

Figure 7:
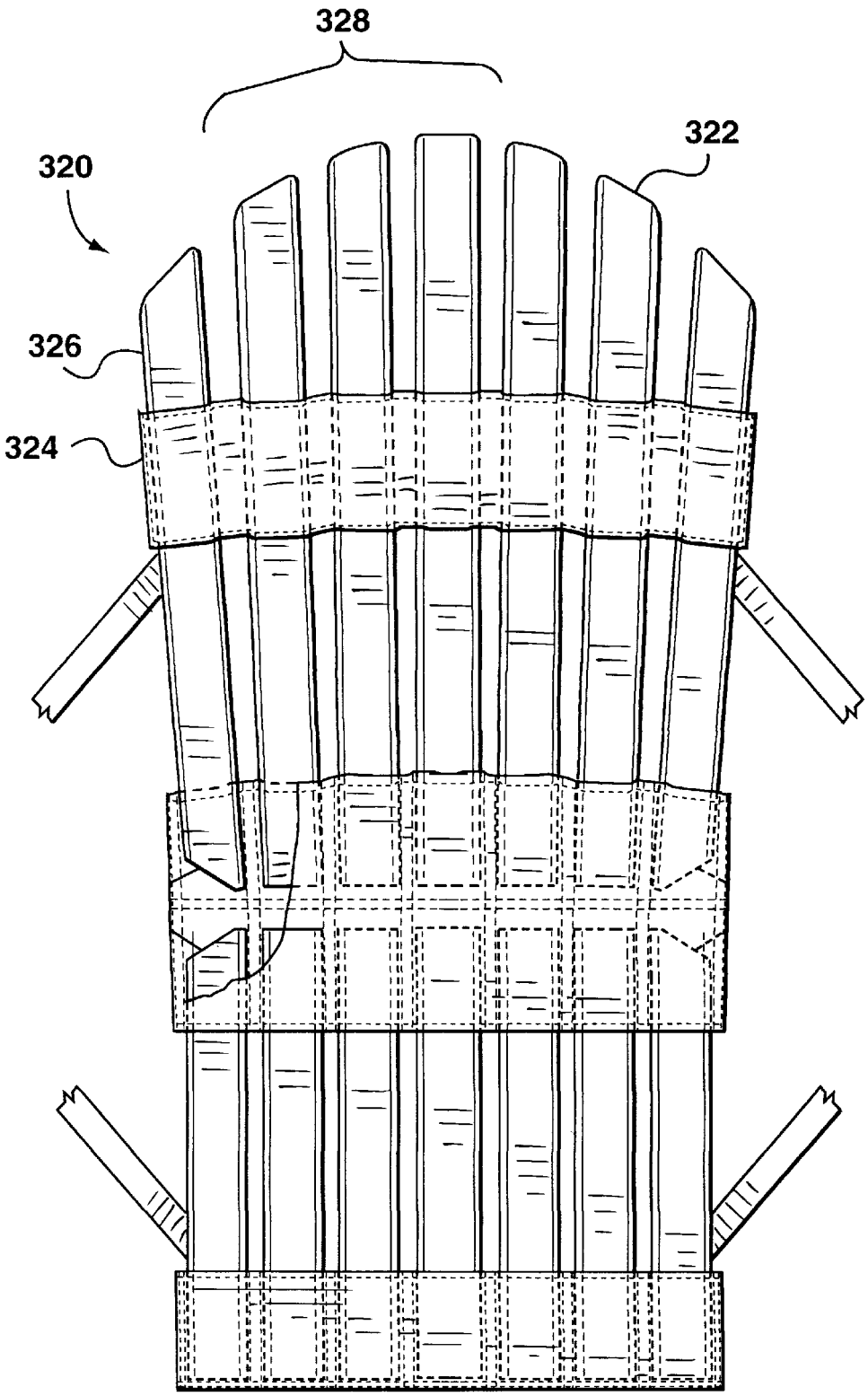
FIG. 7 shows a further alternative to the chair of FIG. 1, in developed form and and only partially assembled.

The seat and back distal end retainers need not necessarily capture the very ends of the slats, but could be in the form of webbing sewn to yield a series of slots open at both ends, and located at some intermediate position between the proximal and distal ends of the respective slats. An example of this is shown in FIG. 7 in which a long backed chair 320 has a backrest portion 322, and a webbed spacing retainer 324 at a distance from the hinge roughly corresponding to the distance shown for the embodiment of FIGS. 1*a* and 1*b*. Backrest portion 322 has an array of slats 326 that continue beyond retainer 324 for some distance, and that extend to support a user's shoulders. In the embodiment illustrated in FIG. 7 the slats have a generally curved end profile 328. Finally, the array of slats 326 of backrest portion 322 is tapered.

A particular preferred embodiment of the invention, and a number of alternative embodiments, have been described herein and illustrated in the figures. Those embodiments are described by way of illustration, and not of limitation, of the invention. The principles of the present invention are not limited to those specific embodiments, but are defined by the claims which follow, and equivalents thereof.

What is claimed is:

1. A foldable chair comprising:

a seat joined to a backrest at a hinge and a pair of outboard stays extending between said backrest and said seat, said stays being operable to limit opening of the backrest relative to the seat;

said backrest having at least a pair of backrest stiffeners extending in a first direction away from the hinge, said stiffeners having distal portions located distant from said hinge, and, when said backrest is folded to a closed position against said seat, said chair being rollable in a second direction transverse to said first direction;

a spacing governor having spaced apart retainers;

said distal portions of said stiffeners being engaged in said retainers in spaced relationship from each other while in use, and at least two of said retainers being undersized relative to the respective stiffeners engaged therein whereby said undersized retainers engage said distal portions of said respective stiffeners in a forced interference fit.

2. The foldable chair of claim 1 wherein said governor has an array of said retainers for receiving an array of stiffeners therein and said governor is fabricated from flexible webbing.

3. The foldable chair of claim 2 wherein said retainers are closed ended pockets for receiving ends of the stiffeners therein.

4. The foldable chair of claim 3 wherein said pockets are of a shape for receiving stiffeners in the form of slats, said slats having a width greater than their thickness, and said pockets have a depth that is at least as great as the width of the slats.

5. The folding chair of claim 1 wherein two of said stiffeners are outboard stiffeners and each has a stay aperture defined in a region thereof distant from said hinge, each said aperture being of a size to permit an end of one of the stays to be introduced therethrough.

6. The folding chair of claim 5 wherein each said outboard stiffener is a slat, and each said aperture is a slot having a slot length oriented such that when the chair is in an open position with a portion of the stay extending away from the slot, a projection of said length parallel to the portion of the stay extending away from said slot is less than 1.5 times the width of the stay.

7. The folding chair of claim 5 wherein each said outboard stiffener is a slat said aperture is a slot having a slot length oriented such that, in an open position of the chair, a projection of said length parallel to the portion of the stay extending away from said slot toward the seat is substantially equal to the width of the stay.

8. The folding chair of claim 5, the stay having a thickness, wherein each said aperture has a width less than thrice the thickness of the stay.

9. The folding chair of claim 5 wherein said outboard stiffener is a slat, said slat has a chamfered end located distant from the hinge, and said aperture is oriented to permit a stay end introduced therethrough to be wound about the chamfered end.

10. The folding chair of claim 5 wherein said governor is glued to at least two of said stiffeners.

11. The folding chair of claim 5 wherein said stays are fed through said apertures, wound about said stiffeners and glued thereto.

12. A kit comprising a foldable chair and a cover therefor, wherein:

said foldable chair has a seat joined to a backrest at a hinge, the seat and the backrest each being stiffened in a direction extending away from the hinge, said backrest being foldable to lie next to said seat in a closed position, and, in said closed position said foldable chair being rollable in a direction transverse to said stiffeners, to a rolled up position; and said cover has an attachment by which said cover is, in use, mountable on the backrest in a position to lie between said backrest and a user's back; and a closure operable to hold said cover in a rolled up position with said chair rolled up within said cover.

13. The kit of claim 12 wherein said cover has a side made of a material chosen from the set of materials consisting of (a) wool;
(b) imitation wool;
(c) natural hair;
(d) synthetic wicking material;
(e) corduroy;
(f) towelling;
(g) felt;
(h) plush;
(i) velvet;
(j) leather;
(k) suede; and
(l) canvas.

14. The kit of claim 12 wherein said cover includes at least one of (a) a lumbar pad;
(b) a heating pad;
(c) a pouch for a lumbar pad; and
(d) a pouch for a heating pad.

15. The kit of claim 12 wherein said attachment is chosen from the set of (a) a harness moveable to a position in which it engages at least a portion of the backrest; and (b) a pocket mountable over at least a portion of the backrest.

16. A foldable chair comprising:

seat joined to a backrest at a hinge and a pair of outboard stays extending between said backrest and said seat, said stays being operable to limit opening of the backrest relative to the seat;

said backrest having at least a pair of backrest stiffeners extending in a first direction away from the hinge, said stiffeners having distal portions located distant from said hinge, the seat and the backrest being stiffened in said first direction and, when said backrest is folded to a closed position against said seat, said chair being rollable in a second direction transverse to said first direction;

a spacing governor having spaced apart retainers;

said distal portions of said stiffeners being engaged in said retainers in spaced relationship from each other while in use, and at least two of said retainers being undersized relative to said stiffeners such that said undersized retainers engage said distal portions of said stiffeners in a forced interference fit;

said stiffeners of said backrest include a pair of opposed outboard stiffeners, each of said outboard stiffeners having an aperture defined in the distal region thereof; and each of said stays has one end fed through one of apertures, said end being wound about its respective outboard stiffener and glued thereto.

17. The foldable chair of claim 16 wherein the respective distal ends of each of said outboard stays are chamfered, and said one end of said stay is wound about said chamfer.

18. The foldable chair of claim 16 wherein said distal regions of said stiffeners have ends, said spacing governor is a web member, said retainers are pockets defined in said member, said pockets being fit over said ends of said distal region, and the respective pockets of said spacing governor engaging said outboard stiffeners cover the portion of the respective stays wound about said outboard stiffeners.

19. The foldable chair of claim 16 wherein said spacing governor is glued to said stiffeners.

* * * * *